United States Patent [19]

Snell et al.

[11] Patent Number: 4,567,855

[45] Date of Patent: Feb. 4, 1986

[54] LIFTING DEVICES

[76] Inventors: Thomas B. Snell, 14, Acreman St., Sherborne, Dorset; Peter S. Kerton, Higher Farm, Chilton Cantelo, Somerset, both of United Kingdom

[21] Appl. No.: 646,671

[22] Filed: Sep. 4, 1984

[30] Foreign Application Priority Data

Sep. 3, 1983 [GB] United Kingdom ..... 8323675

[51] Int. Cl.[4] ..... A61D 3/00

[52] U.S. Cl. ..... 119/103

[58] Field of Search ..... 119/102, 103; 5/449, 5/455

[56] References Cited

U.S. PATENT DOCUMENTS 2,488,993 11/1949 Teague ..... 5/449
3,572,836 3/1971 Khanh ..... 5/455
3,621,819 11/1971 Hooper ..... 119/102
4,185,591 1/1980 Patelis ..... 119/102
4,234,982 11/1980 Bez et al. ..... 5/449
4,491,089 1/1985 Kelly et al. ..... 119/103

*Primary Examiner*—Hugh R. Chamblee
*Attorney, Agent, or Firm*—Andrus, Sceales, Starke & Sawall

[57] ABSTRACT

An animal lifting device has an inflatable mattress (1) carried by an inflatable support structure (2). In plan, this structure is a closed loop, for example rectangular, so that the center of the mattress is over an open space and can sag down into it to cradle an animal lying on it. The outer edge portion of the mattress preferably overhangs the inflatable support. This comprises a number of compartments (4) which can be inflated individually in sequence, progressively to raise an animal from ground level to a convenient working height. Restraints (11) can be adjusted to tilt the mattress to a desired attitude. There are also means (12) for holding an animal down on the mattress.

9 Claims, 2 Drawing Figures

LIFTING DEVICES

This invention relates to lifting devices, and it is concerned with apparatus for lifting and supporting animals for veterinary treatment or surgery. Large animals such as cows and horses cannot be easily lifted up and placed on an operating table, and for the vet to treat them on the ground means an awkward and inconvenient posture. It is desirable to allow the vet to stand naturally at a comfortable height and, possibly, to have the animal tilted at an angle.

According to the present invention there is provided an animal lifting device comprising a mattress and an inflatable support structure surrounding a hollow space below the mattress when inflated.

Preferably, the mattress will also be inflatable. The support structure will conveniently comprise a number of superimposed chambers separately inflatable, so that they can expand one by one vertically, concertina fashion. To achieve this, there may be communication between chambers by valves, the arrangement being such that, when a first chamber is inflated to a given pressure the valve to the second adjacent chamber opens so that the second chamber is inflated via the first and so on in sequence. Alternatively, the chambers may each have an external inlet, and then there may be means for applying fluid under pressure selectively to each inlet.

The inclination of the mattress may be adjustable. There can be external restraints, such as straps, which can be set to limit the vertical expansion of the support structure. Alternatively, the chambers may be subdivided into compartments which can be individually inflated.

Preferably, the mattress will overhang the support structure for comfort of working, and there will generally also be means for restraining or holding down an animal on the mattress.

The device may be entirely inflatable, but it could stand on a rigid base.

For a better understanding of the invention one embodiment will now be described, by way of example, with reference to the accompanying drawing, in which.

The device has an air mattress 1 on an inflatable support structure 2. In plan, the latter forms a hollow rectangle so that when inflated there is a free space 3 below the central area of the mattress. Outside the structure 2 the mattress has an overhang all round, which makes it comfortable to work at.

Figure 2:
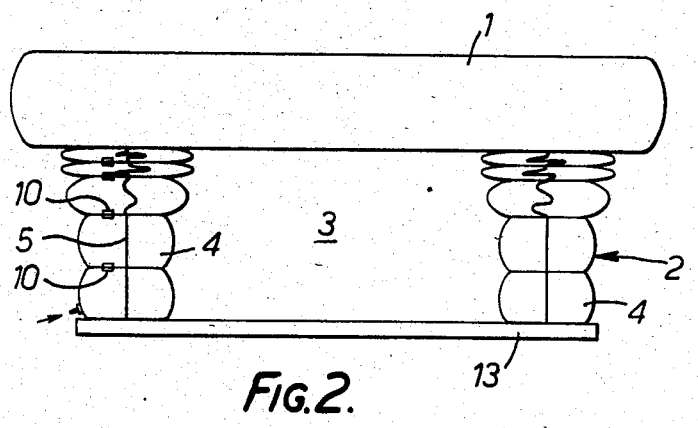
FIG. 2 is a vertical section on the line II—II of FIG. 1, but with the device only partially inflated, and showing a modified inflation arrangement.

The support structure 2 consists of a number of chambers 4, each of rectangular closed loop form, stacked one on top of the other. Inflation causes them to expand vertically, concertina fashion. As seen in FIG. 2, there are internal flexible restraints 5, such as cords, which help check this vertical expansion.

Figure 1:
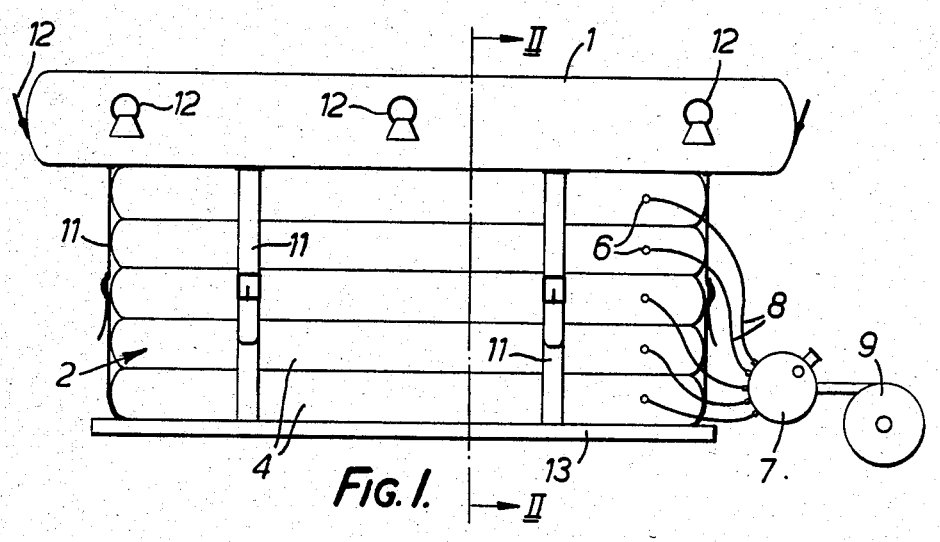
FIG. 1 is a side elevation of an animal lifting device fully erect.

Inflation can be carried out in several different ways. As shown in FIG. 1, each chamber may have its own external inlet 6, and be completely isolated from the adjacent chambers. Each chamber will then be inflated separately, and this may be done in sequence through a distribution valve 7 with individual tubes 8 to the inlets 6, there being a single blower or air pump 9 feeding to the valve. This valve will also be controllable to bleed selected chambers of air if the tubes 8 remain attached. Alternatively, the inlets 6 will be provided with their own control valves so that they can be shut off or opened as desired with the tubes 8 removed. This may be preferred, as the tubes could hamper a verterinary surgeon moving around.

It will be preferred to inflate in sequence, since this maintains the mattress tolerably stable throughout the lift. If all the chambers 4 were only partially inflated, the structure would tend to wobble dangerously, and it would be thoroughly unstable. However, where only one chamber 4 at a time is being inflated, the scope for such wobbling is very much more limited. Once a chamber 4 is fully inflated, although it will have some resilience, it can be regarded as substantially rigid.

An alternative system, as shown in FIG. 2, ensures this sequential inflation automatically. There is a single inlet to the lowermost chamber 4, and relief valves 10 are fitted in the membranes separating the chambers. These will be set so that the lowermost chamber 4 will inflate fully to a given pressure, and then the first valve 10 will open so that continued admission of air fills the next chamber 5. This continues until that chamber is fully inflated, and then the next relief valve 10 opens for the third chamber 4 to inflate, and so on. In practice, the relief valves 10 will not be set directly above one another, as shown in FIG. 2, so that, when the device is deflated, there will not be a stack of superimposed valves creating an inconvenient and possibly damaging lump. Each chamber will have its own external relief valve (not shown) for this deflation.

Generally, it will be desired to have the top of the mattress 1 level. However, this may not always be the case, and to adjust its inclination there are provided vertical restraints at points around the support structure 2. In this example, there are straps 11, and by tightening some and loosening others prior to inflation, the structure 2 will not be able to assume its natural shape. The mattress 1 will therefore be forced to assume a tilt. Adjustments could be made after inflation, although this would probably require some of the pressure to be relieved from the chambers 4 before some of the straps 11 could be shortened.

An alternative to this would be to divide the chambers 4 into compartments or cells. These could then be differentially pressurised to generate tilt.

One technique for lifting an animal is to have the mattress tilted down to the ground and to lean the animal against it. The tilt is then flattened out, and the animal is progressively supported.

The mattress 1 need not be inflatable, although this is most advantageous. The completely deflated device can then be laid virtually flat on the ground and an animal can easily be rolled over onto it. The mattress would then be inflated first, before the support structure 2. The mattress will be prevented from doming upwardly in the middle by internal restraints similar to the ties 5. Its pressure may be relieved to cause it to sag down into the space 3, thereby cradling the animal more securely. Further security may be had by harness or straps attached to points 12. There may further be provided inflatable cushions or bolsters which can be placed on the mattress to support particular parts of the animal. They may be permanently attached.

The lowermost chamber 4 may itself be the bottom of the device, and this had advantages on uneven ground where it will flex to follow the contours. However, a rigid base 13 may be provided, as shown in the figures.

This may be a frame or plate, possibly foldable or dismantleable into smaller sections, to which the inflatable structure can be attached when desired, and when conditions are suitable.

The mattress and support structure do not have to be rectangular, and other shapes are possible. In particular, an indentation in one side would allow the operator to get closer to an animal's abdomen. Also, the chambers 4 need not necessarily have to encompass a complete loop; they may be interrupted by sections of single thickness web.

Air will generally be used to inflate the structure. However, other gases, or even liquid may be used. It may also be useful in certain circumstances to vibrate the bag, for example by pulsating the fluid supply.

We claim:

1. An animal lifting device comprising an inflatable mattress and an inflatable support structure comprising a number of superimposed chambers, separately and sequentially inflatable and surrounding a hollow space below the mattress when inflated.

2. A device as claimed in claim 1, wherein there is communication between chambers by valves, the arrangement being such that, when a first chamber is inflated to a given pressure the valve to the second, adjacent chamber opens so that the second chamber is inflated via the first, and so on in sequence.

3. A device as claimed in claim 1, wherein the chambers each have an external inlet, and there are means for applying fluid under pressure selectively to each inlet.

4. A device as claimed in claim 1, wherein the mattress overhangs the support structure.

5. A device as claimed in claim 1, and further comprising means for restraining or holding down an animal on the mattress.

6. A device as claimed in claim 1, and further comprising a rigid base below the inflatable support structure.

7. A device as claimed in claim 1, and further comprising means for adjusting the inclination of the mattress.

8. A device as claimed in claim 7, wherein said adjusting means are externally adjustable restraints to limit the vertical expansion of the support structure.

9. A device as claimed in claim 7, wherein the adjusting means are provided by subdividing said chambers into compartments, the compartments being differentially pressurisable.

* * * * *